US006807912B2

(12) United States Patent
Willy

(10) Patent No.: US 6,807,912 B2
(45) Date of Patent: Oct. 26, 2004

(54) READY-TO-ASSEMBLE ARTICLES OF FURNITURE

(76) Inventor: Scott Willy, 1870 E. 106th St., Carmel, IN (US) 46032

( * ) Notice: Subject to any disclaimer, the term of this patent is extended or adjusted under 35 U.S.C. 154(b) by 157 days.

(21) Appl. No.: 10/199,874

(22) Filed: Jul. 19, 2002

(65) Prior Publication Data

US 2003/0107254 A1 Jun. 12, 2003

Related U.S. Application Data

(60) Provisional application No. 60/339,172, filed on Dec. 11, 2001.

(51) Int. Cl.[7] ..... A47B 13/00
(52) U.S. Cl. ..... 108/157.14; 108/180
(58) Field of Search ..... 108/180, 186, 108/165, 153.1, 157.14, 157.16, 157.18, 158.12; 51/924; 248/165

(56) References Cited

U.S. PATENT DOCUMENTS

| | | | | | |
|---|---|---|---|---|---|
| 919,257 | A | * | 4/1909 | Seydewitz | 108/157.18 |
| 1,940,117 | A | * | 12/1933 | Carpos | 108/157.18 |
| 2,334,912 | A | | 11/1943 | Eide | |
| 2,543,875 | A | | 3/1951 | Silverman | |
| 2,628,141 | A | * | 2/1953 | Clemens | 108/157.13 |
| 2,635,024 | A | * | 4/1953 | Sanford | 108/157.18 |
| 2,825,101 | A | | 3/1958 | Rubenstein | |
| 3,488,527 | A | | 1/1970 | Barghout | |
| 3,527,497 | A | | 9/1970 | Self | |
| 3,788,700 | A | | 1/1974 | Wartes | |
| 4,082,356 | A | | 4/1978 | Johnson | |
| 4,140,065 | A | | 2/1979 | Chacon | |
| 4,145,827 | A | | 3/1979 | Katsufrakis | |
| 4,165,572 | A | | 8/1979 | Sussman | |
| 4,765,006 | A | * | 8/1988 | Jackson et al. | 5/658 |
| 4,834,450 | A | * | 5/1989 | Stickler | 108/180 |
| 4,869,564 | A | * | 9/1989 | Lechman | 108/180 |
| 4,926,759 | A | * | 5/1990 | Vitsky et al. | 108/180 |
| 5,082,329 | A | | 1/1992 | Mars | |
| 5,263,766 | A | | 11/1993 | McCullough | |
| 5,367,964 | A | * | 11/1994 | Hockensmith | 108/180 |
| 5,653,531 | A | | 8/1997 | Yang | |
| 5,803,548 | A | | 9/1998 | Battle | |
| 5,992,938 | A | | 11/1999 | Jones | |
| 6,264,349 | B1 | | 7/2001 | Morter | |
| 6,615,746 | B2 | * | 9/2003 | Bart | 108/158.12 |
| 6,619,749 | B2 | * | 9/2003 | Willy | 108/158.12 |

FOREIGN PATENT DOCUMENTS

| | | |
|---|---|---|
| JP | 6-311918 | * 11/1994 |

* cited by examiner

*Primary Examiner*—Jose V. Chen
(74) *Attorney, Agent, or Firm*—Maginot, Moore & Beck

(57) ABSTRACT

A system of ready-to assemble (RTA) furniture includes rectangular and circular tables. The tables include a base structure that is formed from several panels and/or spars having an interlocking slot engagement. The base structure defines a number of upper edges that form a support surface for the tabletop. At least some of the edges include a top-locking flange that overhangs a portion of the edge to define a gap therebetween. The tabletop is formed from at least two panels, with at least one of the panels configured for a tight-fit or press-fit engagement within a gap at a top-locking flange to hold the panel in position on the support surface. The panels include complementary inboard edges so that the tabletop panels can be juxtaposed to form a complete tabletop. The RTA furniture system also includes a bed that includes a box-like base structure with slotted side panels. A pair of substantially identically formed end panels can be slid into the slots in the side panels and moved to respective ends of the slots. A pair of center panels extend through a slot in a corresponding side panel for juxtaposition with each other and with the separated end panels. The end panels and center panels can form an interlocking juxtaposition at their respective side edges.

8 Claims, 8 Drawing Sheets

READY-TO-ASSEMBLE ARTICLES OF FURNITURE

REFERENCE TO RELATED APPLICATION

This application claims priority to U.S. provisional application Ser. No. 60/339,172, filed on Dec. 11, 2001, in the name of the same inventor and bearing the same title.

BACKGROUND OF THE INVENTION

The present invention relates generally to articles of furniture. More specifically, the invention concerns furniture that is "ready-to-assemble" or knock-down.

Knock-down or ready-to-assemble furniture has long been a welcome substitute for the traditional, one-piece, articles of furniture. Ready-to-assemble, or RTA, furniture is significantly cheaper than its more formal counterpart, which makes it a viable option for the college student furnishing a dorm room or a first-time apartment dweller or home buyer. Moreover, RTA furniture is popular with children because of the wide range of configurations that can be achieved with this type of furniture.

RTA furniture is also popular with parents because it represents an affordable alternative for furnishing a child's room or recreation or TV room that is subject to abnormal wear and tear. It is well-known that children, and particularly teenagers and young adults, can be extremely hard on furniture. Rather than spend a large amount of money on traditional furniture that will have its ordinary useful life cut short, many parents prefer to furnish with cheaper articles of furniture, such as RTA furniture. While the cheaper furniture may have a shorter life, the much lower cost makes periodic replacement preferable.

Knock-down or RTA furniture has been around for decades. Most prior RTA furniture relies upon interlocking notches and maintaining a tight fit between the spliced notches to keep the article of furniture solid. Of course, over time, the notches would wear and the fit between the components would become so sloppy as to render the article nearly unusable.

In addition, most prior RTA furniture has required specific sets of components, configured to generate a specific type of furniture. Thus, if a consumer wanted a chair, it was necessary to obtain a chair kit, and if a sofa was desired, a sofa kit was required. Knock-down furniture of this type does not take advantage of one possible benefit of RTA furniture, namely the ability to instantly convert one article to another article using many of the same components.

There remains a need for RTA furniture that is both inexpensive and versatile. The furniture must be able to achieve solid construction and to maintain its integrity over long periods of usage. In addition, the RTA furniture must have a desirable, and sometimes fun, appearance.

DESCRIPTION OF THE DRAWINGS

These needs are met by a novel RTA furniture array that is reflected in the following written description together with the accompanying figures.

DESCRIPTION OF THE PREFERRED EMBODIMENTS

Figure 1:
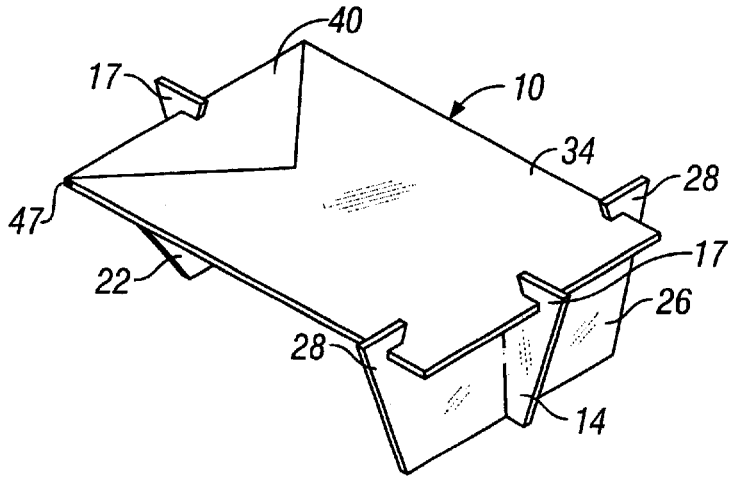
FIG. 1 is a perspective view of a ready-to-assemble (RTA) long table in accordance with one embodiment of the present invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

In accordance with certain embodiments of the invention, a ready-to assemble (RTA) furniture system can include a long table 10, as shown in FIG. 1, and a short table 12, as depicted in FIGS. 2*a–d*. The two tables are substantially similar in construction, except that the overall dimensions of the various components can differ between the tables. For instance, the two tables include a center panel or spar 14 (FIG. 2*a*), a pair of end panels 22 and 26, and a pair of tabletop panels 34, 40. Each of these components can be differently sized and shaped between the two tables 10 and 12. Nevertheless, both tables are assembled in the same manner, as described below.

Referring to FIGS. 2*a–d* and FIGS. 3*a–d* that depict assembly steps for the table 12, it can be seen that the center spar 14 defines an upward slot 15 at one end and a downward slot 16 at its opposite end. The support edge 19 of the spar 14 terminates at its ends in overlapping top locking flanges 17. The purpose of the flanges will be revealed below.

Figure 3A:
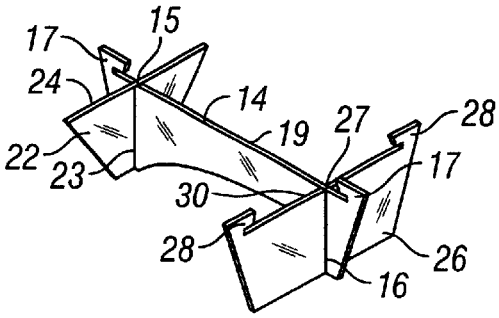
FIGS. 3*a–d* are sequential views of the assembly of the RTA table shown in FIGS. 2*a–d*.

A pair of end panels 22 and 26 connect with the center spar to provide a base structure that can remain free-standing on a floor. The end panel 22 includes a downward slot 23 that mates with the upward slot 15 of the center spar. Likewise, the end panel 26 includes an upward slot 27 that interconnects with the downward slot 16 of the spar. As shown in FIG. 3*a*, the two end panels 22, 26 are engaged to the spar by sliding an end panel into a corresponding slot of the spar.

The end panel 22 defines a support edge 24 that will eventually support a portion of the tabletop. The other end panel 26 also includes a support edge 30; however, unlike the end panel 22, the panel 26 defines top locking flanges 28 at its opposite ends. These flanges 28 can be constructed like the flanges 17 on the center spar.

Figure 3B:
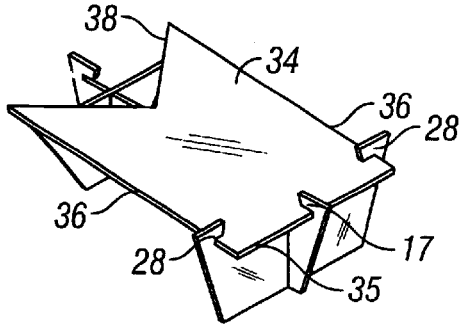

Once the center 14 and end panels 22, 26 have been assembled, a first tabletop panel 34 can be positioned as shown in FIG. 3*b*. The first panel 34 includes an end edge that slides between the support edge 19 and one locking flange 17 of the enter spar. The side edges 36 of the first panel also slide between the support edge 30 and locking flanges 28 in a similar manner. Preferably, the flanges 17 and 28 combine with the corresponding support edges 19, 24 to produce a tight fit for the first tabletop panel 34. The resulting fit can even be a press-fit engagement, requiring a stiff push to press the panel into the flanges 17 and 28.

As shown in FIG. 3*b*, the first tabletop panel defines an end cut-out 38 at the end opposite the end edge 35. In the preferred embodiment, it has been found that a triangular shaped cut-out simplifies the assembly of the RTA table 12. The first panel also defines a locking slot 39 at the free vertices of the end cut-out 38.

Figure 2A:
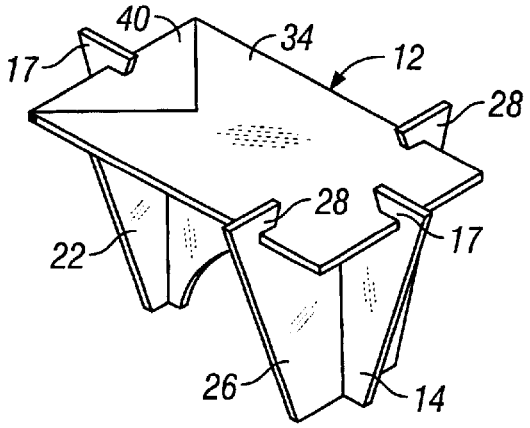
FIGS. 2*a–d* are perspective, end, side and top elevational views of a short table similar to the table illustrated in FIG. 1.
Figure 2B:
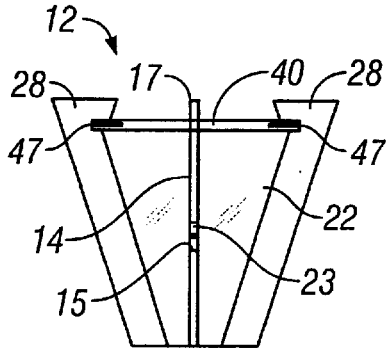
Figure 2C:
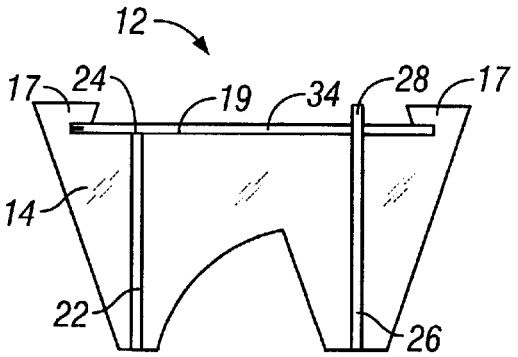
Figure 2D:
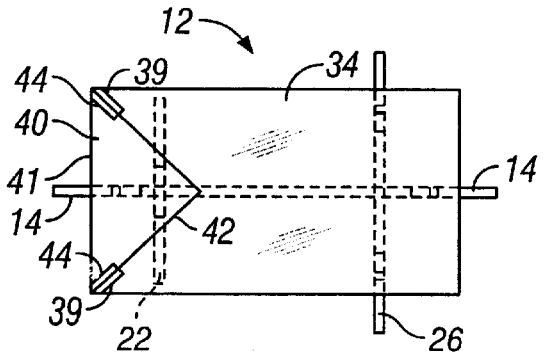
Figure 3C:
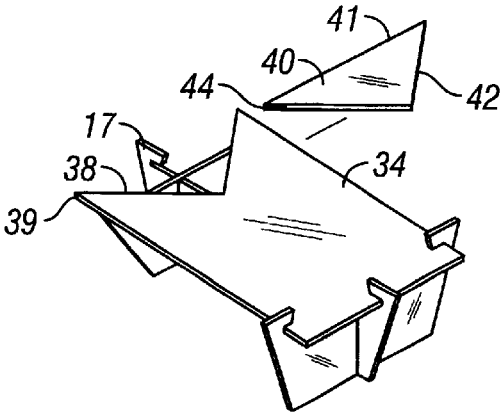
Figure 3D:
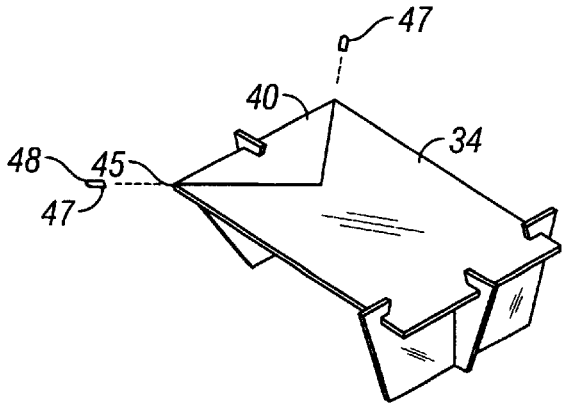
Figure 5A:
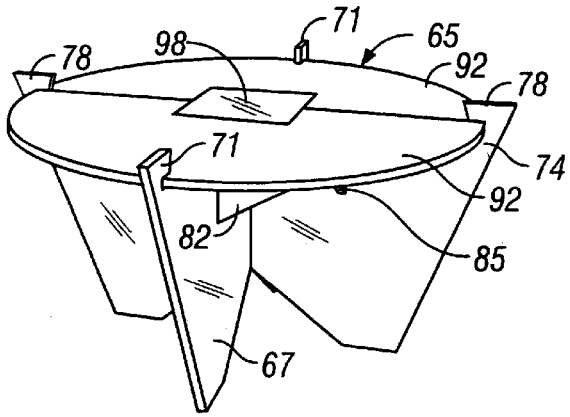
FIGS. 5*a–d* are perspective, end, side and top elevational views of an RTA round table in accordance with a further embodiment of the invention.
Figure 5B:
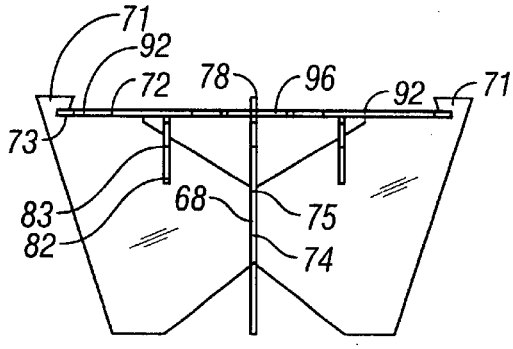
Figure 5C:
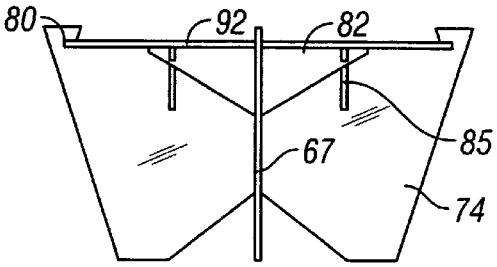
Figure 5D:
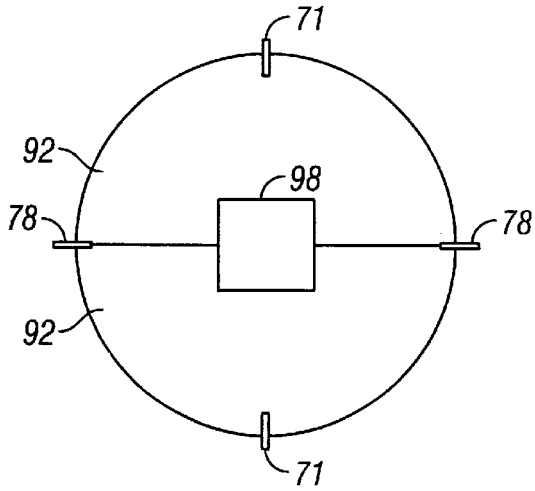

Looking now at FIG. 3*c*, a complete tabletop is achieved by the addition of a second tabletop panel 40. The second panel has a complementary shaped edge 42 that fits snuggly within the end cut-out 38 of the first panel when the two panels are juxtaposed, as depicted in FIG. 2*a*. The second panel 40 also defines a locking slot 44 at opposite sides of its end edge 41. When the second panel is in its final position, as shown in FIGS. 2*a* and 3*d*, the end edge 41 is disposed within a top locking flange 17 of the center spar 14. Again, the locking flange 17 is configured so that a tight fit, or a press-fit, exists between the center spar and the second tabletop panel.

While the resulting construction can be sufficient to hold the two tabletop panels 34 and 40 in place, additional security against accidental dislodgement can be provided by way of the locking slots 39 and 44 in the two panels. These locking slots combine to form a combined slot 45 at opposite corners at one end of the resulting tabletop. A pair of locking pins 47 can be provided that are pressed into the combined slot to thereby lock the two panels together at these corners. Preferably, the locking pins 47 can have a corner tip so that the pins blend smoothly with the corner of the tabletop.

As can be appreciated from the assembly steps shown in FIGS. 3*a–d*, construction of the RTA table 12 is very easy. The table can be just as easily disassembled by removing the locking pins 47 and applying an upward force to the underside of either of the tabletop panels 34 or 40. The panel can be pushed until it clears the thickness of the other panel, at which time the panel can be slid toward the opposite end of the table to free it from the top locking flanges. Preferably, the second tabletop panel 40 is the last to be inserted and the first to be removed in the assembly and disassembly of the table 12.

Figure 4:
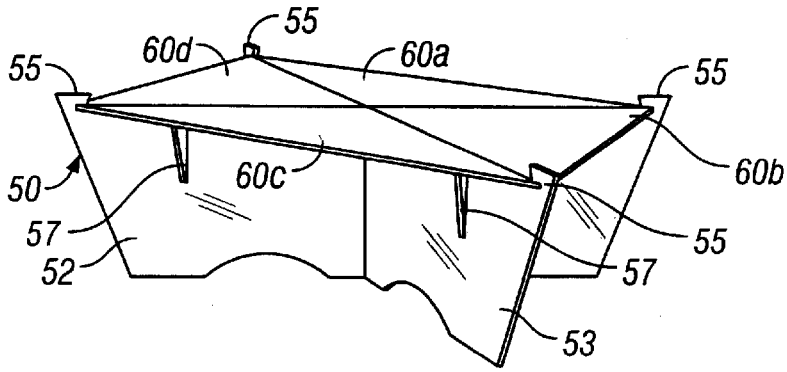
FIG. 4 is a perspective view of an RTA table according to another embodiment of the invention.

The top locking concept incorporated into the tables 10 and 12 can be implemented in a variety of alternative furniture configurations. For instance, the concepts can be applied to a table 50 constructed as shown in FIG. 4. With this table, a pair of crossed panels or spars 52 and 53 are interconnected using the mating slot approach described above. The crossed spars each include top locking flanges 55 at their ends. For added stability, support panels/spars 57 can be added to span between the crossed spars, preferably across the width of the resulting table 50. Again, an interlocking slot construction can be utilized for ready assembly of the support spars 57 to the crossed spars 52, 53.

In this embodiment, the tabletop is formed by four commonly shaped panels 60*a–d* juxtaposed to each other. The panels are constructed to rest on the edges of the spars. In addition, the panels 60*a–d* are lodged within a locking flange, in a manner similar to the table 12 discussed above. In order to preserve the integrity of the assembled tabletop, the locking flanges are preferably located at the corners of the table. Consequently, each of the commonly shaped panels 60*a–d* is in the shape of a triangle. In some embodiments, all of the panels can be identical equilateral triangles. In order to achieve a rectangular shaped table, such as the table 50 in FIG. 4, opposing panels 60*a* and 60*c* can be obtuse, while opposing intermediate panels 60*b*, 60*d* can be acute triangles. As illustrated in FIG. 4, the corner junction between adjacent panels falls within a corresponding top locking flange 55.

A further embodiment of the RTA furniture of the present invention is the round table 65 depicted in FIGS. 5*a–d*, and in the assembly drawings of FIGS. 6*a–i*. As best shown in the assembly drawings, the table 65 includes a cross panel or spar 67 that defines an upward spar slot 68 and a pair of support spar slots 69 at its upper support edge 72. The opposite ends of the cross spar 67 each define a top locking flange 72 similar to the top locking flanges described above.

A second cross spar 74 is provided that is constructed to interlock with the first spar 67. In particular, the second spar includes a downward spar slot 75 for mating with the upward slot 68. The second spar 74 also defines a pair of support spar slots 76 at its upper support edge, as well as top locking flanges 78 at its opposite ends.

Figure 6A:
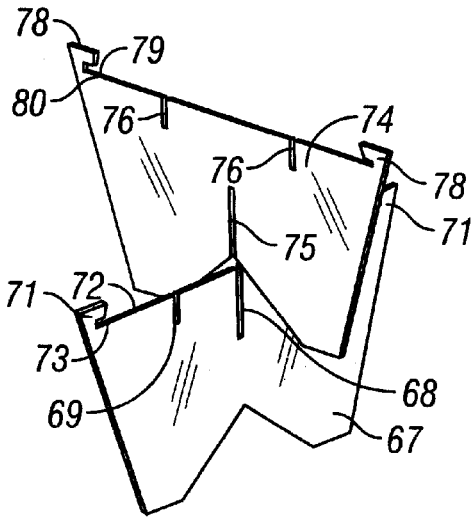
FIGS. 6*a–i* are sequential views of the assembly of the RTA round table shown in FIGS. 5*a–d*.
Figure 6B:
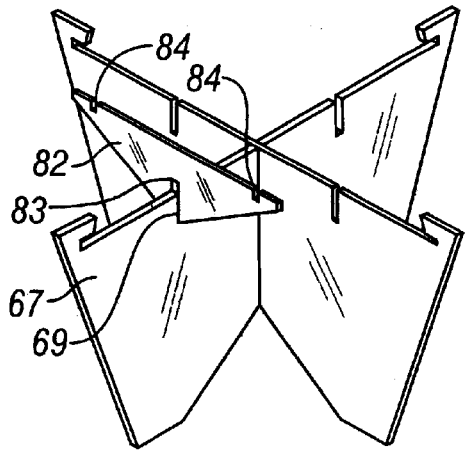
Figure 6C:
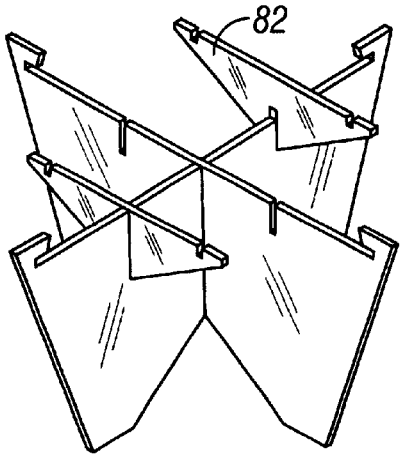
Figure 6D:
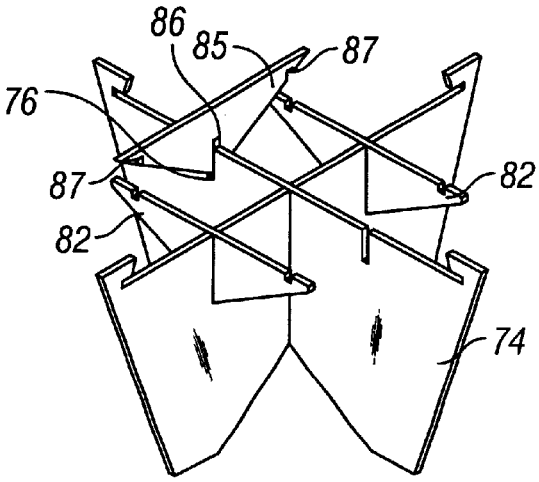

When the two cross spars 67 and 74 are assembled, as shown in FIG. 6*b*, a pair of support spars 82 can be mounted on the first spar 67, as depicted in FIGS. 6*b* and 6*c*. Each support spar includes a downward slot 83 for mating with a corresponding support spar slot 69. In addition, each support spar 82 defines a pair of interlocking notches 84, as shown in FIG. 6*b*. The interlocking notches 84 are configured to mate with corresponding notches 87 on additional support spars 85, shown in FIGS. 6*d–e*. Like the first described support spars, the spars 85 include downward slots 86 for mating with the upward slots 76 in the second cross spar 74.

Figure 6E:
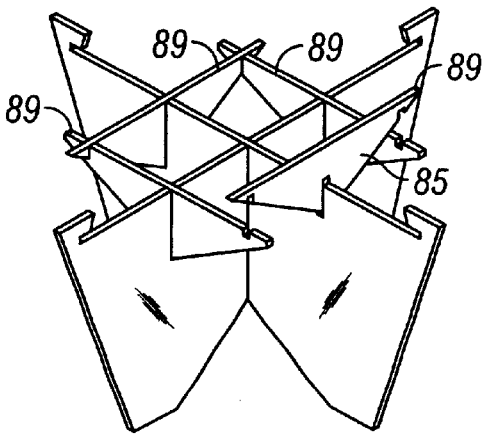

The resulting construction of the various support spars results in a box-like enter support 89, as shown in FIG. 6*e*. This support 89, along with the support edges 72 and 79 of the cross spars 67 and 74, provide a stable surface for supporting the tabletop. The assembly of the tabletop is depicted in FIGS. 6*f–i*. In particular, the tabletop is formed by a pair of identical tabletop panels 92. Each panel 92 defines a center cut-out 93, with an inner locking slot formed at opposite sides of the center cut-out. In addition, outer locking slots are provided at opposite sides of the outer edge 96 of the panel 92.

Figure 6F:
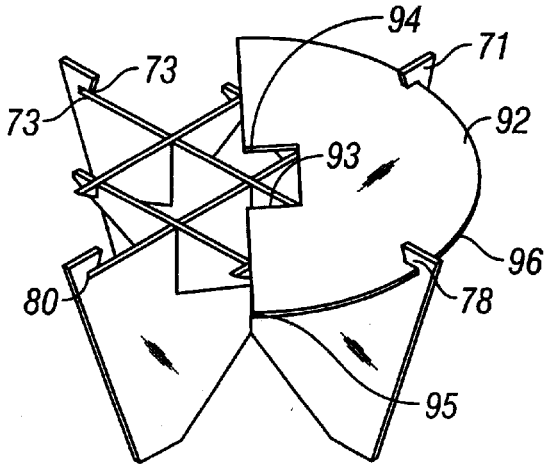

To assemble the tabletop, a first panel 92 is slid underneath a pair of top locking flanges 71 and 78. Again, as with the flanges described above, a tight fit or a press-fit can be accomplished to snugly hold the tabletop panels in place As shown in FIG. 6*f*, the panel 92 is preferably oriented so that the inner edge bisects the support spars and is not positioned beneath a locking flange 71 or 78.

Figure 6G:
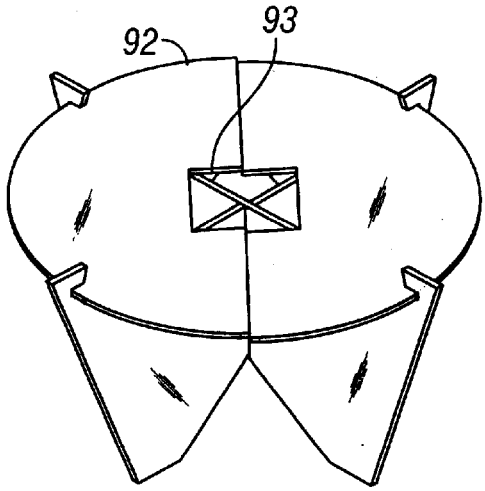

Referring to FIG. 6*g*, the second identical panel 92 can be juxtaposed to the first panel to provide a substantially complete tabletop. When so positioned, the cut-outs 93 in each panel are juxtaposed to form a combined cut-out in the center of the tabletop. In order to facilitate placement of the second panel 92 when a first panel is already in place, the support edges 72 and 79 of the two cross spars 67, 74, are beveled downward at a relief edge 73, 80 beneath a free locking flange. These relief edges are best seen in FIG. 6*f*.

Figure 6H:
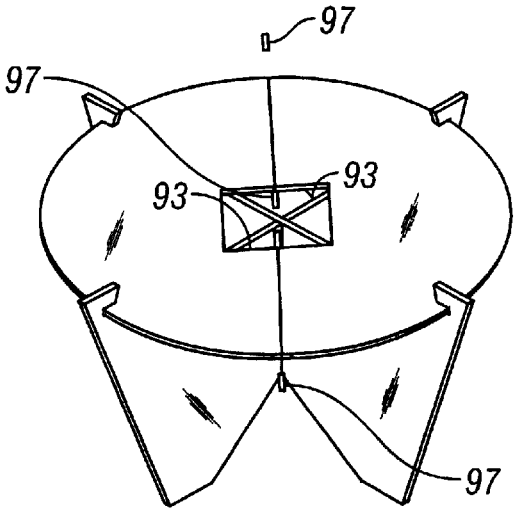

The edges are angled downward so that the second panel can be inserted into the locking flanges 71 and 78 at an angle. When the panel is lodged at the end of the locking flange, it can then be pivoted downward until it rests on the center support 89. At this point, the inner edges of the two panels 92 mate to form a uniform tabletop surface. In addition, the two panels form a center cut-out, as shown in FIG. 6*h*.

Figure 6I:
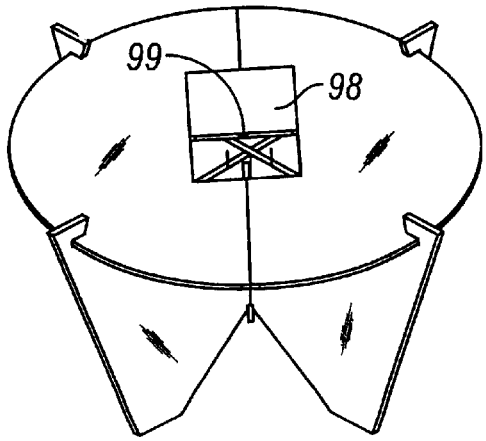

In one embodiment of the invention, the inner and outer locking slots 94, 95 of the two panels form combined slots, like the combined slot 45 in the table 12 described above. A pair of locking pins 97 can be inserted into the combined outer locking slots to lock toe two panels together. In addition, a single locking pin 97 can be positioned within a combined inner locking slot at the center cut-outs 93 of the panels. In the final step of the assembly, the center tabletop panel 98 can be placed within the cut-outs 93, as shown in FIG. 6*i*. The center panel 98 can define a locking slot 99 at each side edge thereof. The center panel can be slid over the exposed end of the locking pin 97 at the inner cut-out of the combined panels 92.

In addition to the top locking aspect of the tables 10, 12, 50 and 65, the present invention contemplates a further feature embodied within the various panels used to form the tabletop. Using the table 65 as an example, it can be seen that three panels (two panels 92 and center panel 98) are used to form the tabletop. Each of these panels can be of identical surface finish; however, each can also be of a different surface finish or material. For instance, the two primary panels 92 can be formed of wood, while the center panel 98 can be formed of a translucent or transparent material. For that matter, each of the panels, as well as each of the supporting spars can be of different color, textures or outer profiles. In addition, the center panel can include integral functional elements, such as an integral lazy-susan.

The components of these RTA tables can be formed of a variety of materials, such as wood or plastic. Preferably, the tabletop panels are formed of a material that can be compressed slightly to allow for a solid lodgment of the panels within the various top locking flanges. Alternatively, the locking flanges can exhibit some springiness to generate a clamping force against the tabletop panels. It should be appreciated that the RTA tables of the present invention require no tools to assemble or disassemble, and consequently the components do not require intricate machining to produce.

The present invention also contemplates sleeping furniture, such as beds 105 and 150 shown in FIGS. 7*a–d* and 11*a–d*, respectively. The two beds exhibit different aesthetic appearances, but both are constructed and assembled in a common manner. Using the bed 105 as an example, this RTA furniture item includes a pair of identical side panels 107. Each side panel defines a side slot 108 that extends along a substantial portion of the panel length, as shown best in FIG. 8. In addition, the panel 107 defines upward and downward notches 109 and 110, respectively, at opposite ends of the panel. Optimally, the notches have the same length and are disposed at the same distance from the end edge of the panel. With this configuration, the side panels 107 are universal and it will not be necessary to determine a proper orientation of the panel when assembling the bed 105.

The bed 105 further includes a foot board 112 that bears slots 113 for engaging the slot 109 in each of the side panels 107. The foot board can include a support edge 114. A headboard 116 is also provided that includes slots 117 for inter-engagement with the slot 110 in the side panels. The side panels, footboard and headboard can be readily assembled to form a generally rectangular box. It should be apparent that these components can have a variety of ornamental configurations. For instance, the side panels can be formed as the side panels 151 of the bed 150. Likewise, the footboard can be formed like the footboard 152 and the headboard like board 153.

Figure 9:
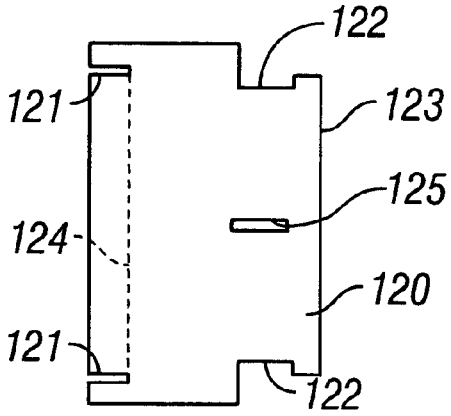
FIG. 9 is a top elevational view of an end support panel for use with the RTA bed shown in FIGS. 7*a–d*.

Referring again to FIG. 7*d*, the bed 105 includes support panels 120 and 128 for supporting a mattress and box-springs. The bed construction of the present invention contemplates two identically configured end support panels 120, shown in detail in FIG. 9. The end panels can include end notches 121, adjacent the opposite sides of the panels that are configured to engage the slots 108 in the side panels. In the assembly of the bed, one end panel 120 is passed through the slots 108 in opposite side panels 107. The end panel is then slid toward the footboard 112 until the slot 121 engages the side panels 107.

Figure 7A:
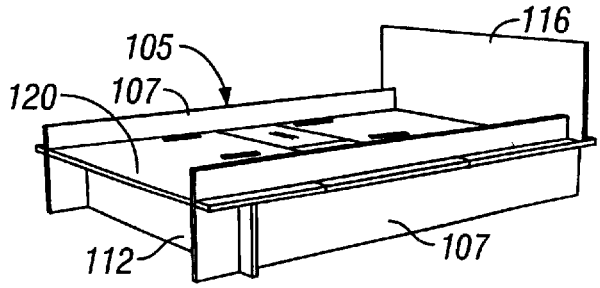
FIGS. 7*a–d* are perspective, end, side and top elevational views of an RTA bed in accordance with a further embodiment of the invention.
Figure 7B:
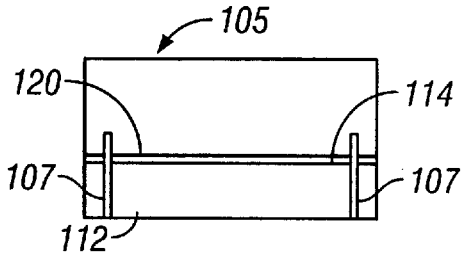
Figure 7C:
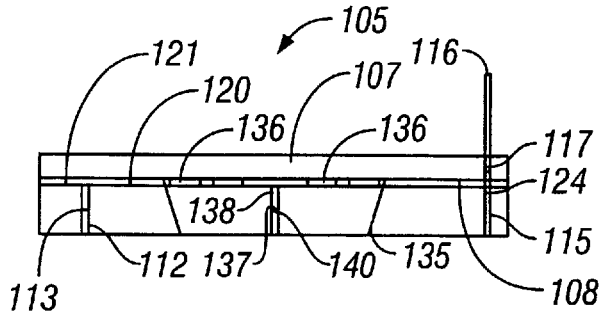
Figure 7D:
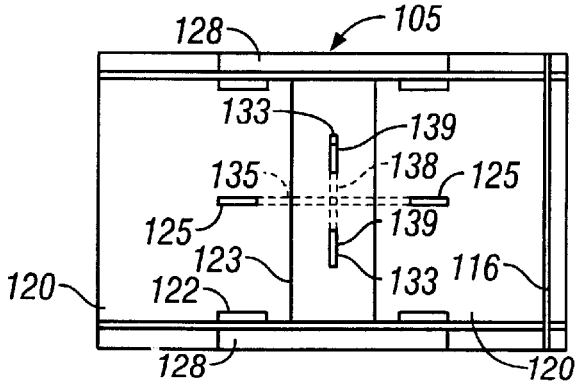
Figure 8:
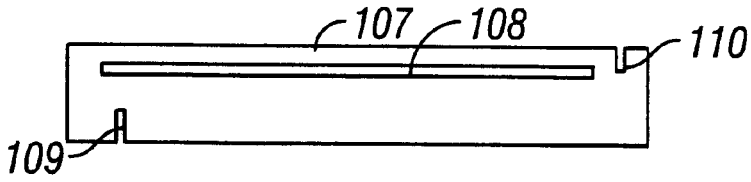
FIG. 8 is a side elevational view of a side panel for use with the RTA bed shown in FIGS. 7*a–d*.

A second identical end panel 120 can be similar positioned at the headboard end of the bed 105, as shown in FIG. 7*d*. In certain embodiments, one of the end support panels 120 can include a width-wise slot 124 (shown in phantom in FIG. 9) between the notches 121 and the headboard 112 can include a downward tab 115 to slid into the slot 124.

Figure 10:
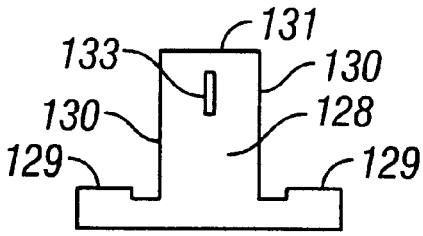
FIG. 10 is a top elevational view of a center support panel for use with the RTA bed shown in FIGS. 7*a–d*.

With the two end panels 120 in position separated toward the opposite ends of the side panels 107, the center support panel 128 can be inserted into the center portion of the slot 108. The center panel 128 can be of a T-shape, as shown in FIG. 10. The panel can include tabs 129 at the opposite ends of the "T" that can interlock with corresponding cut-outs 122 in each end panel 120. The side edges 130 of the center panel 128 bear against the inboard edges 123 of the end panels 120. The end edge 131 of the center panel contact the end edge of another center panel 128 inserted through the slot 108 in the opposite side panel. Thus, as shown in FIG. 7*d*, the four panels, two panels 120 and two panels 128, combine to form a continuous support surface for a mattress and box-springs.

In order to provide more support in the center of the bed 105, a center spar 135 and cross spar 138 can be included. The two spars include mating slots 137 and 140 that interlock like the spars and panels incorporated into the tables 10, 12, 55 and 65. The end panels 120 can include a center slot 125 and the center support panels can include center slots 133 to receive corresponding tabs 137 and 139 of the interlocked spars 135 and 138, respectively. The center and cross spars 135 and 138 not only support the middle of the bed support panels, the tabs also operate to hold the various panels in their juxtaposed position shown in FIG. 7*d*.

Looking now at FIGS. 11*a–d*, an alternative bed design is illustrated. The bed 150 can be constructed and assembled in a manner similar to the bed 105. The bed 150 includes side panels 151, footboard 152 and headboard 153. Two end support panels 155 and two center support panels 156 close the center of the frame formed by the panels and boards.

With this embodiment, the footboard can be modified to include a downward ground-engaging tab 154. The tab can fit through a slot 159 in one of the end support panels 155. A similar arrangement can be implemented at the headboard 153.

Figure 11A:
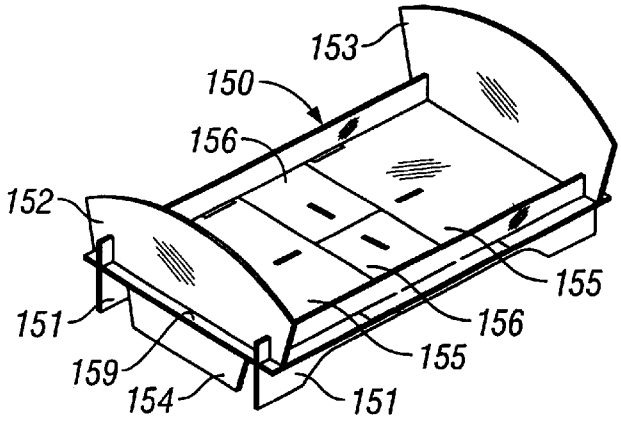
FIGS. 11*a–d* are perspective, end, side and top elevational views of an RTA bed in accordance with an additional embodiment of the invention.
Figure 11B:
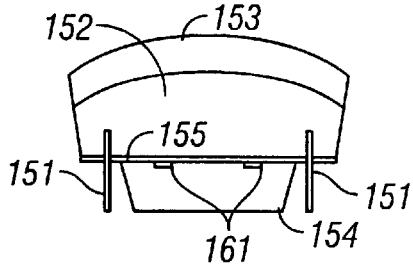
Figure 11C:
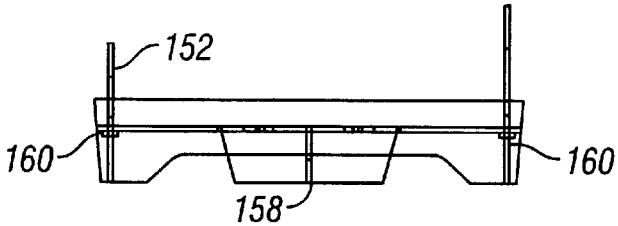
Figure 11D:
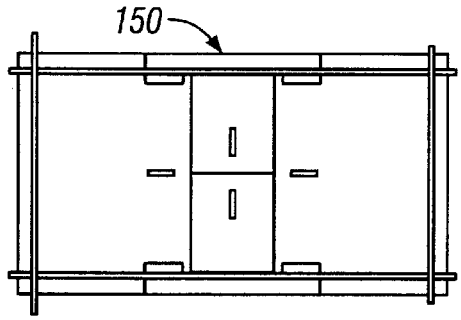
Figure 12:
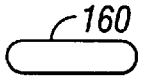
FIG. 12 is a top elevational view of a locking member for use with the bed shown in FIGS. 11*a–d*.

In a further feature of this embodiment, the tab 154 of the footboard 152 can define a pair of spaced-apart slots 161, as shown in FIG. 11*b*. The slots receive locking members 160 (FIG. 11*c*) that are press-fit into the slots. The locking members serve to hold the footboard 152 in its assembled position. In addition, the locking members 160 can provide additional vertical support for the end of the end support panel 155. A similar construction can be implemented at the headboard end, as shown in FIG. 11*c*. In one embodiment, the locking members are elongate with rounded ends, as illustrated in FIG. 12. The length of the locking members 160 is slightly greater than the length of the slots 161 to effect a press-fit.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected. Other style variations of furniture and accessories may readily incorporate the principles of the present invention.

What is claimed is:

1. A ready-to-assemble (RTA) table comprising:

an elongated center spar having an upper edge and a locking flange at each end thereof overhanging a portion of the tipper edge to define a gap therebetween and an interlocking slot at each end thereof;

an elongated first end panel having an upper edge and an interlocking slot for engagement with an interlocking slot at one end of said center spar;

an elongated second panel having an upper edge and a locking flange at each end thereof overhanging a portion of the upper edge to define a gap therebetween, and an interlocking slot for engagement with an interlocking slot at an opposite end of said center spar;

a support surface defined by the upper edge of said center spar, said first end panel and said second end panel defining;

a first tabletop panel supported on a portion of said support surface and having an end edge at one end configured for tight-fit engagement within the gap at said opposite end of said center spar, opposite side edges configured for tight-fit engagement within the gap at each end of said second panel, and a cut-out defined at an opposite end thereof; and a second tabletop panel supported on another portion of said support surface and having an end edge at one end configured for tight-fit engagement within the gap at said one end of said center spar, and an opposite edge having a complementary shape to said cut-out and configured to be juxtaposed within said cut-out when said end edge of said second panel is within the gap.

2. A ready-to-assemble (RTA) table comprising:

a first elongated spar having an upper edge and a locking flange at each end thereof overhanging a portion of the upper edge to define a gap therebetween;

a second elongated spar having an upper edge and a locking flange at each end thereof overhanging a portion of the upper edge to define a gap therebetween;

an interlocking arrangement between said first and second spars so that the locking flanges are disposed substantially uniformly apart;

a support surface defined by the upper edges of said first and second spars when the spars are interlocked;

a pair of identically configured semi-circular panels having an outer edge configured for tight-fit engagement within each of the gaps, and each of said panels defining a cut-out that forms a center cut-out when the pair of panels is juxtaposed and supported on said support surface; and a center panel configured for placement within said center cut-out when supported on said support surface.

3. A ready-to-assemble (RTA) article of furniture comprising:

a box-like base structure having opposite side panels, each of said side panels defining an elongated slot;

a pair of substantially identically configured end panels, each having an end edge with a pair of notches extending therein and opposite side edges, each of said pair of end panels configured to fit through said slot in each of said side panels and to be slid toward opposite ends of said slot so that said pair of notches in each of said end panels engages a corresponding opposite end of said slot, said pair of end panels having an inboard edge, the inboard edges of the pair of panels spaced apart when said panels are at said opposite ends of said slot; and a pair of substantially identically configured center panels, each configured to fit through a slot in a corresponding one of said side panels, and each having opposite side edges for juxtaposition with the inboard edges of the pair of end panels and each having an end edge for juxtaposition with each other when each enter panel is extended through the slot in a corresponding one of said side panels.

4. The RTA article of furniture of claim 3, wherein:

each of said pair of end panels defines a cut-out in said opposite side edges adjacent said end edge; and each of said pair of center panels is T-shaped with opposite tabs configured for juxtaposition within a cut-out in each of said pair of end panels when each center panel extends through a slot of a corresponding one of said side panels.

5. The RTA article of furniture of claim 3, further comprising a support structure spanning each of said pair of end panels and said pair of center panels and disposed within said box-like base structure.

6. The RTA article of furniture of claim 5, wherein said support structure includes:

an elongated center spar having tabs at its opposite ends;

an elongated cross spar having tabs at its opposite ends;

an interlocking slot engagement between said center spar and said cross spar; and slots defined in said pair of end panels and said pair of center panels configured to receive said tabs of said center spar and said cross spar.

7. The RTA article of furniture of claim 3, wherein said box-like base structure further includes:

a footboard panel;

a headboard panel; and an interlocking slot engagement between said baseboard panel and said pair of side panels and between said headboard panel and said pair of side panels.

8. The RTA article of furniture of claim 7, wherein:

at least one of said pair of end panels defines a slot between said pair of notches adjacent said end edge; and at least one of said footboard panel and said headboard panel includes a tab configured to extend through the slot in the end panel when the end panel is engaged to said side panels.

* * * * *

UNITED STATES PATENT AND TRADEMARK OFFICE

CERTIFICATE OF CORRECTION

PATENT NO. : 6,807,912 B2
DATED : October 26, 2004
INVENTOR(S) : Scott Willy

It is certified that error appears in the above-identified patent and that said Letters Patent is hereby corrected as shown below:

Column 7,
Line 21, replace “tipper” with -- upper --

Signed and Sealed this

Twenty-fifth Day of January, 2005

JON W. DUDAS
*Director of the United States Patent and Trademark Office*